United States Patent [19]

Prohaska

[11] 4,431,111

[45] Feb. 14, 1984

[54] CLOSURE CAP FOR BEVERAGE CONTAINERS

[75] Inventor: Helmut Prohaska, Neuhofen, Austria

[73] Assignee: Folienwalzwerk Bruder Teich Aktiengesellschaft, Obergrafendorf, Austria

[21] Appl. No.: 367,737

[22] Filed: Apr. 12, 1982

[51] Int. Cl.[3] ..... B65D 41/42

[52] U.S. Cl. ..... 215/256; 215/260; 215/307

[58] Field of Search ..... 215/254, 256, 260, 255

[56] References Cited

U.S. PATENT DOCUMENTS

| | | | |
|---|---|---|---|
| 2,423,295 | 7/1947 | Crabbe et al. | 215/260 |
| 2,652,165 | 9/1953 | Wener | 215/254 |
| 3,216,602 | 11/1965 | Koll | 215/254 |
| 3,367,524 | 2/1968 | Lake | 215/256 |
| 3,974,931 | 8/1976 | Moller | 215/254 |
| 4,069,936 | 1/1978 | Ota | 215/256 |

FOREIGN PATENT DOCUMENTS

| | | | |
|---|---|---|---|
| 2456695 | 6/1976 | Fed. Rep. of Germany | 215/254 |
| 1368893 | 10/1974 | United Kingdom | 215/256 |

*Primary Examiner*—Donald F. Norton

*Attorney, Agent, or Firm*—Silverman, Cass & Singer, Ltd.

[57] ABSTRACT

A bottle closure cap stampable from sheet metal as a shallow cylindrical inverted dish having a rounded juncture forming a fillet between its crown and its cylindrical wall; a layer of elastomeric material being disposed in the fillet and engageable with the axial end of the bottle when the cap is attached. A generally radially extending rip tab is integral with the cylindrical wall at the bottom edge thereof and is adapted to tear through the cylindrical wall by a generally circumferential pull of the user to gain access to the container. A rip line is provided commencing at a corner defined by the bottom edge of the cylindrical wall where it meets the rip tab. The rip line extends at a shallow angle across the cylindrical wall to a level which is spaced below the crown, continuing parallel to the crown circumferentially about half-way around the closure cap. The installed closure cap can relieve excessive interior pressure and reseal itself, the closure cap pressure in the container being relievable gradually while the rip tab is being pulled to gain access to the container.

22 Claims, 12 Drawing Figures

FIG. 5
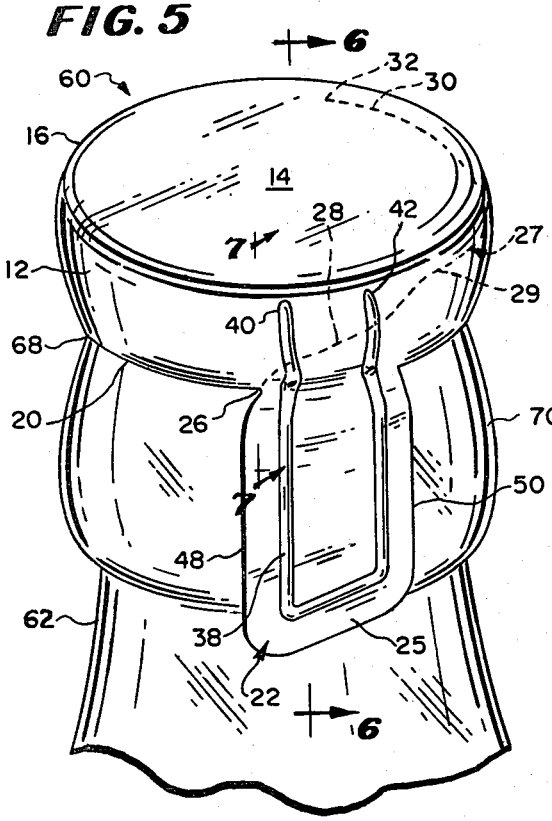
FIG. 6
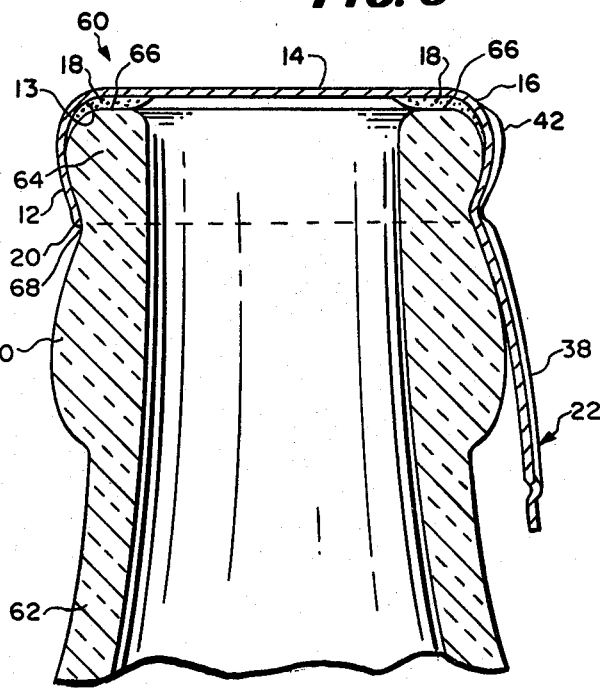
FIG. 7
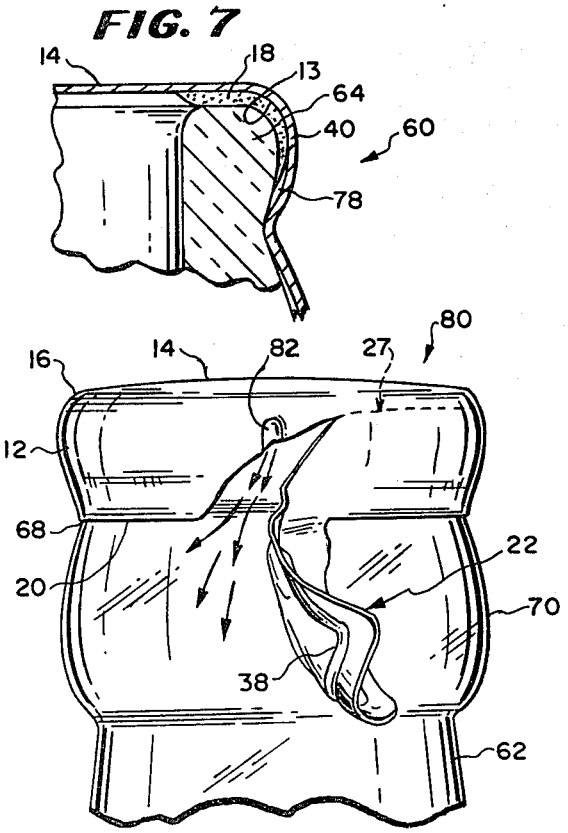
FIG. 8
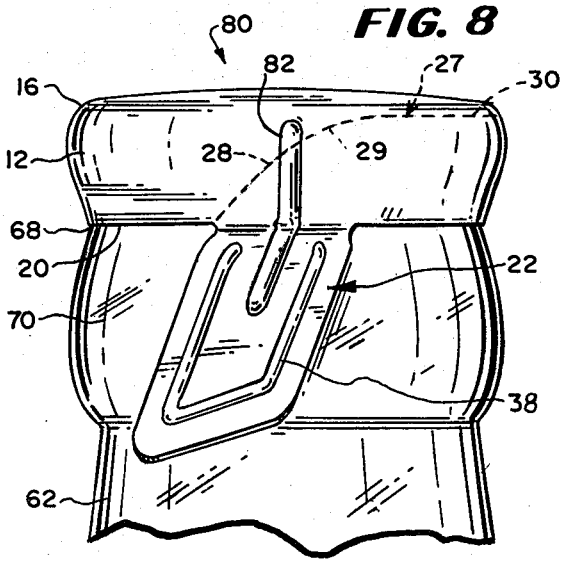
FIG. 9

CLOSURE CAP FOR BEVERAGE CONTAINERS

FIELD AND BACKGROUND OF THE INVENTION

The field of the invention is closure caps for containers and more particularly is the provision of a novel closure cap which is formed of thin sheet metal and is adapted to be installed onto the top of a beverage bottle of glass or plastic.

Although not limited thereto, the closure cap of the invention is especially intended for use with glass bottles that are used world wide for containing soft drinks and brewed beverages such as beer and ale. The design and dimensions of the open end of such bottle has been fairly standardized and is designated by the standard DIN 6094 in foreign countries, such open end or so-called mouthpiece having a beaded outer rim with an exterior diameter of 26.5 mm. This same standard is universally used in the United States.

The invention has many advantages over the types of closure caps which are in use today and which are known through prior art patents that have not practically been embodied in commercial examples. These advantages will to some extent be brought out by describing some prior art closure caps and explaining their disadvantages.

So far as known there is no commercially available closure cap which is reliably capable of relieving the pressure within a beverage container without blowing off the closure cap. Bottled beverages consist generally of two types, those which are gaseous and those which are still. Both types may be required to pass through autoclaves for pasteurization purposes and thereby are subjected to high pressures produced by the elevated temperatures that are involved. Pasteurization of beer, for example, is effected at a temperature of about 72° C. in which the internal pressure of a container will rise to well over 10 bars (one bar equals 1 megadyne per square centimeter) for a beverage that has about 4 or more grams of carbon dioxide per liter dissolved in the liquid.

At such pressures and higher, which are common in the beverage industry, containers are known to burst. This is especially true in the case of glass bottles which are of the refillable type. Fatigue and weaknesses in used bottles are difficult to detect and the result of breakage is loss of the contents in addition to the inconvenience of removing the broken materials from the machinery.

Closure caps made according to the invention can be made to self-vent for a typical closure cap at pressures as much as 10 bars, the venting having no effect upon the subsequent sealing of the container. The pressure within the container thus drops to as low as 5 bars or so and upon build-up will again vent without adverse effects. Breakage and loss of contents are thereby reduced if not eliminated in pasteurizing beverages. The invention also enables closure caps to be made for self-venting and sealing at pressures which are substantially lower than 10 bars.

In the case of sterilizing which is effected usually for liquids which are not gaseous, the autoclave temperatures are from about 123° C. to 133° C. and are maintained at this temperature for up to 40 minutes. The pressures can and usually do rise to values which can burst containers in such cases and the closure caps of the invention will vent long before the breaking point of the container thereby saving the container and the contents while not interfering with the sterilization process.

Gaseous beverages such as soft drinks and beer are also subjected to high pressures during storage and transportation and even while in the possession of the user. Heat and agitation of the container will increase the internal pressure and can result in explosions of the containers. There are losses of containers and contents in transportation, storage and even in sales outlets where ambient conditions result in high temperatures. As for the explosion of containers in the possession of users, this is most common with used containers but occurs with new containers as well and is a constant source of expense for bottlers who are required to provide insurance and defend against lawsuits for injuries. Even more importantly, there is always a danger to the user of carbonated beverages from injuries which could be sustained through explosion of the container where the internal pressure is excessive or becomes excessive through high temperature or agitation.

Another problem with prior closure caps has been the crazing and chipping caused by the application of the closure cap to the container and such damage caused by the user when opening the same. This is especially true with the so-called crown caps that are crimped in place with multiple dimples or crimps and which require a bottle opener to remove the same. In either case the user will not imbibe in the contents because of the presence of glass chips or evidence on the bottle opening that such chips or shards of glass may have fallen into the bottle.

This disadvantage is eliminated by the invention because the closure caps of the invention can be installed onto containers with substantially less axial pressure than prior closure caps. For example, in the case of crown caps compared to the closure caps of the invention, the axial pressure required for reliably sealing the closure caps of the invention is at least 25% less than required for crown caps. The crown caps which are meant are those which generally have an interior disc-like gasket of cork or similar material within the crown.

There is another disadvantage of prior closure caps of all kinds. This has to do with the opening of the container for use. The contents are under pressure and the degree of pressure is dependent upon the temperature and the amount of agitation to which the container has been subjected. The act of opening the container for all types of closures, not only the crown cap type, is accepted as adventuresome by users—not because of enjoyment but because there is no way of controlling the release of pressure. It can be gradual or explosive, the latter being the most common type of relief. The contents of the containers may be expelled during the opening to varying degrees causing inconvenience and annoyance.

According to one aspect of the invention this disadvantage is alleviated if not completely eliminated by providing for controlled relief of the internal pressure of the container contents during the opening of the container by the closure cap of the invention.

An important advantage of the invention is concerned with the inherent self-valving effect of the closure cap which occurs during the period when the container carrying the closure cap is pasteurized or heated for other purposes at temperatures which are below that required to sterilize the contents. This advantage is that the valving effect enables the discharge of some of the air which may have been included with the contents during filling. If not replaced by the gases in the liquid contents a slight vacuum may obtain above the liquid. In either event the growth of bacteria of the aerobic type is inhibited.

It has been difficult if not totally impractical to apply closure caps of a type which are applied by axial engagement to plastic bottles because of the danger of crushing the bottle or collapsing its neck. The axial pressure used to install the closure cap of the invention is so low that the successful application to plastic bottles is a reality. The need for expensive screwcap types of closures is thus eliminated along with the possibilities that the cap may be removed illegally and other contents substituted in whole or in part. The closure cap of the invention is wholly pilfer-proof because the closure cap is physically and obviously altered in the act of removal.

There are several types of closure caps besides the crown cork crimped or the crown cork twist-off types which are used on bottles and each has its disadvantages. These are variously known as "Alka", "Rip Cap" and "Maxicap". The latter two have parallel rip lines which pass over the top or crown of the closure so that the user must either pull the tab all the way to divide the closure into three pieces or he must manipulate the cap parts to separate them for removal from the bottle in order to gain access to the contents. There is no need to describe the inconvenience and difficulties with such closure caps. Manipulation of the cut-open parts can result in finger injuries.

The type of closure cap which has been referred to as "Alka" is characterized by a pull tab and a weakened rip line that tears away a portion of the wall of the cap leaving the user to manipulate the remainder of the cap from the bottle. On the other hand the closure cap of the invention is simple and effective because it is easily removed by a single circumferential movement that so fully loosens the cap that it is easily picked off by the user. Notwithstanding this, the cap can be replaced onto the bottle and will remain in place whereby the contents may be kept clean for a time. The pressure is not retained after opening but the bottle can be covered by the closure cap sufficient to protect the contents temporarily.

The closure cap of the invention is preferably made out of aluminum or an aluminum alloy. Accordingly it is light in weight and rust-proof. Other thin sheet metals could be used with advantage if properly formed and installed as will be explained hereinafter. Steel would have to be lacquered or otherwise coated to prevent rust; hence the aluminum closure cap is preferred.

In the crown cork type of closure cap the sides of the closure cap are ribbed making it difficult to carry graphic material legibly thereon. The side wall of the closure cap of the invention is smooth with a minimum of wrinkles which provides much space for graphic material in addition to eliminating sharp protruding edges which could cause injuries.

Especially in the case of aluminum closure caps according to the invention, application is rapid and the forces required are less than in the case of the ordinary closure caps made out of steel.

Many other advantages and attributes of the invention will become obvious as a description of the preferred embodiments is set forth hereinafter.

SUMMARY OF THE INVENTION

A closure for a beverage bottle of the type which has an upper beaded rim and the cap being formed of thin bendable sheet metal in a configuration which is a shallow inverted dish-like member having a cylindrical side wall and a flat planar crown, the bottom edge of the side wall being substantially circular. There is a rounded junction about the upper part of the dish-like member which is the corner of the dish-like member and the crown and which forms an interior fillet. A layer of gasket material is adhered inside the dish-like member in the fillet extending less than the full extent downward on the side wall and preferably only part way on the interior of the crown whereby to form an annular ring of such material.

The ring of gasket material is adapted to be sealingly engaged against the axial end of the beaded rim of the bottle when the closure cap is installed on the bottle.

There is a rip tab connected to the side wall at the bottom edge thereof and extending outwardly of the side wall generally horizontally when the closure cap is formed and before installation and extending generally downwardly and over the bulge of the bottle below the rim when the closure cap is installed on the bottle.

A rip line is coined in the inner surface of the side wall during formation of the closure cap and commences at the corner defined by the meeting of one side edge of the rip tab and the bottom edge of the side wall, extending on a shallow angle upwardly and circumferentially around the side wall past the other side edge of the rip tab to a continuation part which is spaced slightly below the crown and parallel with the crown. The complete extent of the rip line is about half way around the side wall terminating on the same level as the continuation part. Under certain circumstances the rip line may have its central part, that is, between its ends extend into the rounded junction to ensure venting during opening.

The dish-like member and rip tab are formed integrally by punching and drawing from sheet metal, preferably aluminum or aluminum alloy, during the course of which there may be strain hardening.

The closure cap is installed upon the bottle by a collet-like tool with fingers that engage the side wall while pressing the crown against the axial end of the bottle rim to effect a seal between the gasket material and the said axial end. The fingers form the side wall into a configuration which follows the contours of the beaded rim closely so that the bottom edge of the side wall is crimped into the groove which is formed between the beaded rim and the bulge that is provided below that rim on the conventional beverage bottle.

There may be additional strain hardening during the installation but in any event the installed closure cap is of such resilience that it is capable of relieving excess pressure within the bottle by self-venting and then resealing itself, such occurring at predetermined pressures. There may be one or more passageways formed in the side wall in the vicinity of the rip tab to provide controlled pressure relief during the opening of the bottle.

BRIEF DESCRIPTION OF THE DRAWINGS

FIG. 5 is a front perspective view of a closure cap constructed in accordance with the invention, said cap being similar to that of FIG. 1 but differing slightly, the closure cap in this view having been installed upon a standard beverage bottle a portion of which is fragmentarily shown;

FIG. 6 is a median sectional view taken through the closure cap along the plane 6—6 of FIG. 5 in the indicated direction;

FIG. 7 is a fragmentary sectional view taken generally along the line 7—7 of FIG. 5 and in the indicated direction;

FIG. 8 is a fragmentary side elevational view of another modified form of the invention installed on the top of a bottle;

FIG. 9 is a view similar to that of FIG. 8 but showing the manner in which the rip tab is pulled to open the bottle;

DESCRIPTION OF THE PREFERRED EMBODIMENTS

The invention is generally concerned with a closure cap especially for bottles of glass and plastic in which the contained liquid is under pressure. The pressure may be caused by gas which is occluded in the beverage contained in the bottle, as for example carbonated soft drinks or beer and which increases in pressure due to rising temperatures or comes out of solution due to agitation; it may be caused by temperatures deliberately raised during the process of pasteurizing or sterilizing the contents of the bottle within the bottle prior to sale; or it may be caused by conditions occurring during storage or handling or even by rising ambient temperatures.

The invention comprises the closure cap to be described and claimed and is also directed to the combination of the closure cap and a bottle of the type which has a rounded upper rim.

The basic structure of the closure cap is rather simple when considered cursorily, having the appearance of a relatively shallow inverted cylindrical dish of sheet metal with a pull tab or rip tab integral with the bottom edge of the side wall of the closure cap. The juncture of the disc-like like top or crown and the cylindrical side wall is rounded to form a fillet and a layer of gasket material is disposed in the fillet on the interior thereof. When installed on a bottle, the bottom edge of the side wall is crimped under the lip of the bottle in the reverse crease or groove which is defined between the rounded rim and the enlarged bulge that is formed on the conventional bottle below the rim, the rip tab protruding downwardly alongside of the bulge.

The bottle is opened simply by pulling the rip tab in a circumferential movement and separating a portion of the side wall from the main body of the closure cap, this portion comprising a strip alongside the lower edge of the side wall extending about halfway around the closure cap and including all of the rip tab the upper half of the interial of the wall.

This simple appearing closure cap and the installed cap itself have attributes which provide economy, safety and efficiency because of the manner in which the closure cap is constructed that does not readily appear from a casual examination thereof. Among these are its ability to self-vent and reseal; its ease of installation; its ease of removal; its ability to release pressure while it is being removed from the bottle; and many other benefits.

Figure 1:
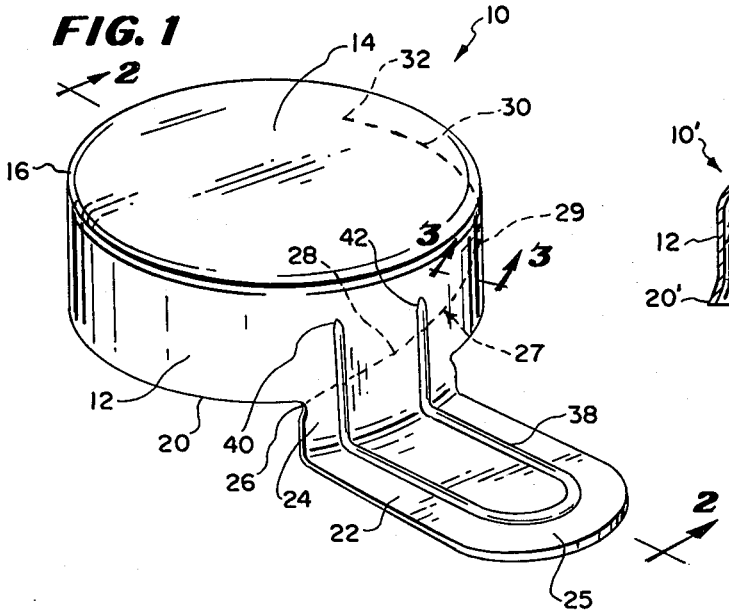
FIG. 1 is a perspective view of a closure cap constructed in accordance with the invention and shown prior to installation onto the top of a bottle or the like container.

In FIG. 1 there is illustrated a closure cap 10 constructed according to the invention. There is an inverted cylindrical dish-like formation which is comprised of a cylindrical side wall 12, a crown 14 which is a flat planar disc, the annular juncture 16 between the crown 14 and the side wall 12 being rounded to form a fillet 13 on the interior of the closure cap 10. This fillet 13 is provided with a layer of gasket material shown at 18, the gasket material being generally elastomeric and specifically being a well-known compound such as polyethylene, PVC or other thermoplastic materials which are resilient at the temperatures to which cold beverages are normally kept and which are not fluid at the temperatures to which beverages are normally subjected during pasteurization and sterilization. The preferred material is a type of so-called plastic foam that is run into the fillet in liquid form and then cured by baking.

The gasket material 18 is in the form of a ring which does not extend to the bottom edge of the side wall 12 and does not extend radially inward of the bottom surface of the crown 14 much beyond the distance which will bring the ring 18 against the upper axial end of the bottle (see FIGS. 6 and 7) upon which the closure cap 10 is installed. The sealing which is achieved by the closure cap 10 of the invention makes it unnecessary to utilize any more gasket material than the ring 18 described although a full disc completely engaging the bottom of the crown 14 could be used.

Figure 2A:
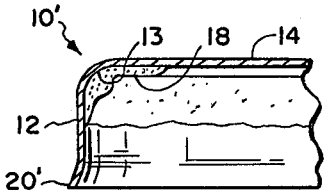
FIG. 2*a* is a fragmentary sectional view of a modified form of the closure cap of FIG. 2.

The bottom edge 20 of the side wall 12 will be turned inwardly by crimping when the closure cap 10 is installed as will be explained but when the closure cap 10 is formed it is punched and drawn from sheet metal and the drawing process is preferably effected by a simple cylindircal punch and cylindrical cavity. In this manner the resulting side wall 12 is right cylindrical and the bottom edge 20 will lie in the cylindrical plane defined by the side wall 12. If desired the bottom edge may be slightly flared as shown at 20′ in FIG. 2*a* in the case of the closure cap 10′. This may assist in piloting the closure cap onto the bottle mouthpiece during installation but is not essential to the invention.

Figure 2:
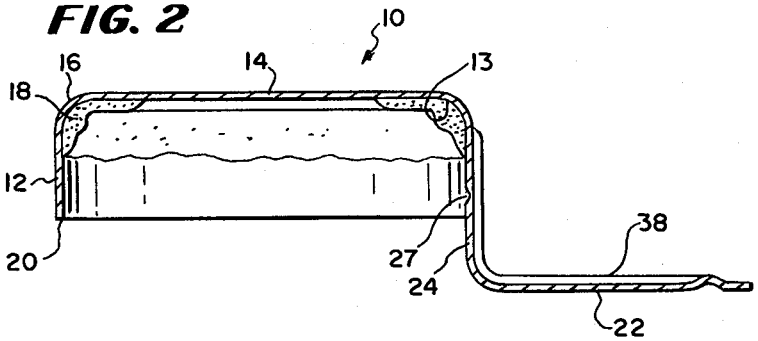
FIG. 2 is a median sectional view taken through the closure cap of FIG. 1 along the plane 2—2 of FIG. 1 and in the indicated direction.

There is a rip tab 22 which is integral with the side wall 12 and which normally extends approximately horizontally as shown in FIG. 2 when the closure cap 10 is formed. The length of the rip tab 22 is chosen to enable the user comfortably to grasp the same for pulling. Also, it should be long enough to extend past the bulge of the bottle which occurs just below the beaded rim when installed so that the tab will not lay against the bulge and be difficult to pull away from the bulge when it is desired to open the bottle.

The rip tab 22 will have a portion 24 which is a continuation of the side wall 12 downwardly to provide some "slack" to enable the closure cap to be crimped in place during installation without unduly distorting the rip tab. Typically for a standard beverage bottle having the outer diameter of the beaded rim as 26.5 mm., the width of the rip tab 22 is 14 mm and its overall length including the portion 24 is about 17 mm. Inasmuch as the circumference of the side wall 12 before installation is almost 84 mm, the connection of the rip tab with the lower edge occupies only a small fraction of its circumference. The end 25 of the rip tab 22 is rounded in the closure cap 10 but could be of any different configuration.

The juncture between the rip tab 22 and the bottom edge 20 of the side wall 12 is preferably slightly narrowed as shown at 26 to promote ease of tearing when it is desired to open the bottle. In the installation process there will be a slight necking at this point in any event.

There is a rip line 27 provided in the side wall 12 which extends approximately halfway around the side wall 12 and which is made up of three parts 28, 29 and 30 that are, however continuous in the rip line of FIGS. 1 and 2. The rip line 27 starts at the corner juncture 26 and the first part 28 rises at a shallow angle relative to the horizontal. The second part 29 continues up toward the crown 14 and horizontally as the part 30 just below the crown 14 and extends about halfway around the closure cap. The angle with the horizontal for the parts 28 and 29 can be between 15° and 45° for a good practical arrangement. The part 30 may be about 2.5 mm below the plane of the crown 14 or slightly more but should be low enough so that the majority of the ring 18 will not be disturbed. In this way when the closure cap is being removed the seal will be retained as long as possible. Also there should be a pull strip generated below the rip line 27 that has a width of 2 or 3 mm to resist breaking during the pulling operation.

The rip line 27 extends about halfway around the closure cap 10 for a distance of between 140° and 180° and terminates at 32 at the same level as the part 30. The length of the rip line 27 should be sufficient so that the closure cap is easily removed after the line has been traversed and the lower edge of approximately half of the side wall 12 has been pulled away.

Figure 3:
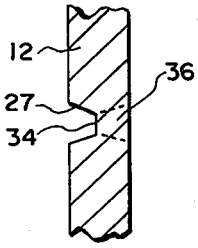
FIG. 3 is a fragmentary sectional view taken through the rip line of the closure cap of FIG. 1 along the line 3—3 and in the indicated direction.

The rip line 27 is formed in the closure cap 10 during the fabrication of the cap. It is coined into the blank of the sheet metal in the flat before the shape is formed in the drawing dies. The tool for the rip line is preferably one which has a flat end and is tapered to that flat end. The result is a groove such as shown in FIG. 3, the bottom wall of the groove being flat as at 34. It is believed that the area under the groove of the rip line 27 which is indicated at 36 is weakened by this particular configuration of the rip line 27 making it easier to tear the rip tab 22 along the rip line 27 but without weakening the overall strength and hence the sealing ability of the closure cap 10. The groove of rip line 27 opens to the interior of the side wall 12.

The rip tab 27 has a strengthening rib 38 in the form of a U-shaped protuberance, but the upper ends of the rib at 40 and 42 extend well above the level of the bottom edge 20 for an important purpose. They cross the rip line part 28 and at least the rib end 40 extends into the area where the ring 18 is located. Since there is a groove on the opposite surface from the rib 38, that is, on the interior surface of the side wall 12, the end 40 will extend as a groove into the ring 18. Even though the sealing compound 18 may fill this groove, when the rip tab 22 is torn along the rip line 27 the weakest part of the seal will be at the end 40 and this is the first place that pressure from the interior of the bottle is likely to escape past the seal provided by the ring 18. This will be explained in detail below.

As mentioned previously, the closure cap 10 of the invention will self-vent reliably at a predetermined pressure and reseal itself. Prior closure caps tended to blow off rather than vent reliably such that bottlers would prefer to cap bottles so tightly that the bottles themselves would burst if blow offs didn't occur.

The venting function is achieved by the choice of materials combined with the structure and method of attaching the closure cap.

Practical examples have been constructed which will vent at pressures between 8 and 10 bars thereafter lowering the pressure within the container to about 5 bars and resealing. Such closure caps were made out of sheet aluminum that had been blanked and formed by drawing using conventional forming techniques. In one example, the aluminum was between 180 and 190 microns thick and had a tensile strength of between 120 and 160 Newtons per $mm^2$. The aluminum itself was about 99% pure. Beverages having an internal pressure of about 5 or 6 bars are the most popular but these will achieve a pressure well over 10 bars when agitated or subjected to heat or both.

In the formation of the closure cap 10 and its installation upon a conventional bottle the procedure is to enclose the closure cap in a suitable fingered collet and lower the collet onto the bottle. The cap is pressed against the axial end of the rim of the bottle by sufficient pressure to displace slightly the compound of the ring 18. The collet is then contracted around the bead of the rim of the bottle and crimps the lower edge 20 of the side wall 12 into the annular groove between the beaded rim and bulge of the bottle. At the same time the upper corner 16 is caused to conform to the rounded edge of the beaded rim of the bottle by a decrease in curvature of the junction 16.

This action of installation coupled with the effect of forming the closure cap produces a work hardening which is believed to be uniform around the closure cap. It is readily reproduceable and can be controlled by making slight changes in thickness and tensile strength of the aluminum. For aluminum alloys moderate experimentation will enable the proper parameters to be chosen which will give the desired venting effect within a reasonably predictable range of pressures.

It has been found that the venting effect is capable of being achieved with aluminum sheeting of conventional composition with thicknesses between 140 and 250 microns and having tensile strengths between 90 and 220 Newtons per $mm^2$. Preferred ranges are 180 to 220 microns and 130 to 180 Newtons per $mm^2$, respectively. The tensile strength mentioned is prior to forming of the closure caps 10 and 10'. In the process of forming it is believed that there is a strain or work hardening of the aluminum which either of itself or combined with the work hardening during the installation of the closure cap provides a condition to produce the venting described. There is a slight expansion of the closure cap and/or a raising of the cap on the bottle top which permits some of the gas in the top interior of the bottle to escape. The resilience of the work hardened sheet metal of the closure cap 10 thereafter returns the cap to its original sealed condition.

Some examples of aluminum alloys which have produced successful closure caps capable of self-venting are contained in the following table:

| Aluminum | Tensile Strength N/mm$^2$ |
|---|---|
| 3003 soft | 120 |
| 3003 hard | 250 |
| 99.0 soft | 84 (36% elongation) |
| 99.0 hard | 160 (2.7% elongation) |

The venting effect is not required for all beverages after bottling but most of the so-called still beverages which have little or no occluded gases are pasteurized or sterilized at elevated temperatures immediately after bottling. In such cases the ability to vent for relieving pressure produced by the expansion of the air contained in the neck of the bottle above the beverage is desirable to prevent bursting of the bottle in the autoclave.

The closure cap of the invention is advantageous even in cases where the venting capability is not required or used because of its simplicity of construction, ease of application to the bottle top and the ease of removing the closure cap.

In the several different forms of the invention which are described herein, wherever the same or similar components are illustrated the same reference characters will be used to designate the components in all views.

Figure 4:
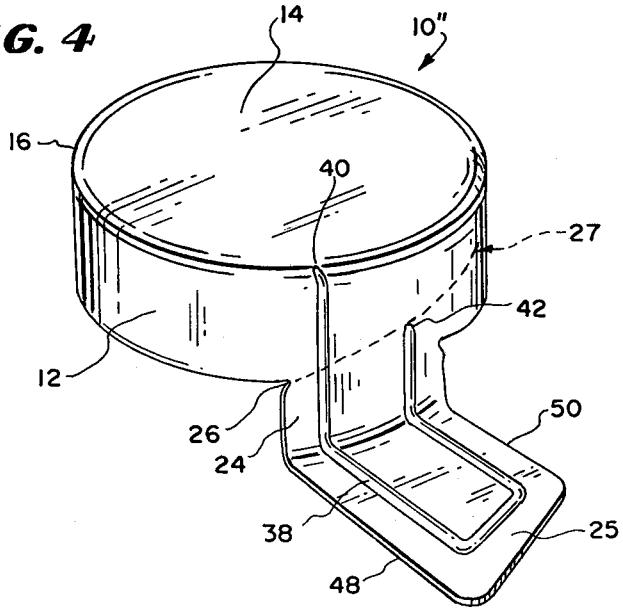
FIG. 4 is a perspective view of a somewhat modified form of the closure cap of FIG. 1.

In FIG. 4 there is illustrated a closure cap 10" which is similar in all respects to the closure cap 10 of FIG. 1 with two exceptions. The first difference is that the end 25 of the rip tab 22 in the closure cap 10" is more or less squared off but arranged at an angle by making the near edge 48 longer than the far edge 50 so that the user will have a tendency to prefer holding most of the rip tab on the left side and pulling it to the right. Since the rip line 27 commences at the corner 26 which is the juncture of the near edge 48 with the bottom edge 20 of the side wall 12 the tearing of the rip line 27 will thus commence in the proper direction. This rip line 27 will normally not be visible to the user because it is formed on the interior of the cap. Thus the formation of the rip tab with this angled end 25 is helpful as an aid in the opening of the closure cap.

The second difference between the closure cap 10" and the closure cap 10 of FIG. 1 is that in the case of the former the inner end 40 of the U-shaped rib 38 extends upward a distance which brings it almost to the crown 14. In this manner it provides a weakened area of the compound 18 where the rib intersects the ring 18. The interior groove formed is also on a part of the side wall 12 and forms a channel to the rip line 27 from the ring 18. When the installed closure cap 10" is opened the upper end 40 of the rib 38 will be the weakest place for escape of pressure from the interior of the bottle because there is least pressure of the ring 18 against the bottle at this point. The gas from the interior of the bottle will escape so that by the time the rip tab has been fully manipulated the internal pressure has been relieved and the closure cap 10" will not be blown off.

It is not known with certainty that the path taken by the gas will be between the ring 18 and bottle end or between the ring 18 and the interior of the fillet 13 but the weakness produced by a discontinuation in the uniform pressed engagement at the interior of the rib 38 will relieve gas one way or the other. If the ring 18 is not adhered to the interior metal surface of the fillet 13 gas may pass between the ring and metal to the bottom of the groove formed under the rib 38 on the side wall 12.

In the case of prior closure caps, as the cap is removed there is no control over the relief of pressure. This often results in a sudden expelling of the liquid all around the bottle and often is accompanied by the closure cap flying up dangerously.

The second upper end 42 of the rib 38 of closure cap 10" may also extend fully up to the juncture 16 if desired to provide additional and/or subsequent venting during opening of the bottle or may be a bit shorter as shown.

It has been found in the case of closure caps which have strengthening ribs that do not extend above the rip line 27 at the part 28 that as the closure cap is opened by pulling the rip tab 22 gas pressure may start being relieved at the corner 26 and/or slightly beyond the corner as the separation of the parts of the side wall 12 follows up the slanted portion 28 of the rip line 27. Thus there is here a rapid release of internal pressure also, but the relief of the pressure is not as controlled with regard to location and timing as in the case of instances where there is a rib or several ribs that extend up the side wall 12.

In FIGS. 5 through 9 the closure cap of the invention is illustrated installed upon a bottle and thus having a somewhat different shape because of the deformation effected during the installation process.

In FIGS. 5, 6 and 7 there is illustrated a closure cap 60 which is very similar to the closure cap 10" of FIG. 4. Here the cap 60 has been installed upon a standard type of beverage bottle 62 only the upper portion of which is illustrated. The bottle 62 is shown in section by the cross hatching symbol for glass because this is the type of bottle with which the invention has the most advantages but it will be understood that the same general configuration could be used in plastic beverage bottles and the closure cap of the invention would advantageously be used therewith. This is of importance because so far as known prior art metal tear-off closure caps cannot be used with plastic bottles because of the degree of axial pressure needed to install such prior art caps. Plastic bottles designed to contain beverages generally have screw type upper ends and require special screw-type closure caps with special machinery for installing the same. This increases the cost of the bottles as well as the cost of the closure caps.

The standard bottle 62 has an upper end which provides a beaded rim 64 having an axial end 66 which has a slightly flattened central portion but basically is somewhat rounded. The bottom of the beaded rim 64 turns inwardly and terminates in a annular groove or crease 68 at the neck of the bottle 62. This forms the so-called mouthpiece of the bottle. Below the groove the bottle has an outward bulge 70 which strengthens the bottle. The configuration of this type of bottle is standard world-wide and in practically all cases the maximum diameter across the bead 64 is 26.5 mm. The interior diameter of the side wall 12 is of a dimension such that the closure cap can be snugly placed onto the bottle top as the first step of installation.

In FIGS. 5, 6 and 7 the closure cap 60 differs from the closure cap 10" of FIG. 4 only in the length of the upper ends 40 and 42 of the rib 38. The same type of rip tab 22 is utilized and the remainder of the construction is the same. The closure cap 60 has been installed upon the beaded rim 64 of the bottle 62 in the manner described above. The axial end 66 of the rim has been pressed against the gasket ring 18 sufficiently to establish a good seal and the side wall 12 has been crimped under the beaded rim 64 and its lower edge 20 brought into tight engagement with the groove 68 to lock the closure cap 60 in place. This has been done by means of a collet type of device having a plurality of fingers shaped to conform as closely as possible to the contours of the beaded rim 64. The crown 14 of the closure cap 60 is held tightly against the rim end 66, but with much less axial pressure than used for other metal closure caps, and the fingers of the collet contracted to shape the metal to the contours shown. While this occurs the curvature 16 of the juncture will be shaped to follow the contours of the beaded rim compressing the gasket ring 18. The bottom of the side wall 12 has practically no visible corrugations notwithstanding the crimping action so that graphic material thereon (normally applied to the sheet metal before forming the closure cap) is clearly legible.

It is believed that there will be additional work hardening in this installation process which makes the closure cap 60 resilient and capable of relieving internal pressure from the interior of the bottle over a predetermined range of such pressure. Choice of the composition of the sheet metal and the thickness and tensile strength prior to formation of the original closure cap enables the manufacturer of the cap to achieve a fairly precise range at which the closure cap will relieve pressure and reseal itself. As stated, one specific embodiment was capable of relieving pressure between 8 to about 10 bars after which the cap would reseal itself when the internal pressure dropped to about 5 bars.

During the crimping operation the rip tab 22 will be bent downward as shown in FIG. 6 to overlie the bulge 70 and extend below the bulge making it easy to grasp and manipulate. As stated the angled configuration of the end 25 promotes the tendency for the user to pull the rip tab 22 in the proper direction to tear the closure cap 60 open.

Although shown in a manner which requires the rip tab 22 to be pulled circumferentially to the right as shown in the views, if the rip line 27 is formed to extend to the left of the rip tab 22 the movement in opening the bottle would require the user to pull the tab to the left. In such case the angled end 25 would be formed opposite to that shown.

It should be clear that the relief of pressure which has been discussed in connection with the closure cap self-venting is automatic and is not concerned with the subsequent opening of the bottle. The controlled relief of pressure which has been mentioned, on the other hand is concerned with the act of opening the bottle and is brought about by the user utilizing the rip tab 22.

When the user pulls the rip tab 22 to the right in a generally circumferential movement to open the bottle 62 the tearing starts at the corner 26 and continues on the angle of the rip line 28 until the rib 38 is reached. Looking now at FIG. 7 it can be seen that the underside of the rib 38 provides a groove 78 which forms a passageway up to the end 40 of the rib. At this point it is likely that the compound of the ring 18 will fill the groove formed under the rib, providing a weakened line through the ring 18 well into the gasket material. This is therefore the weakest part of the seal and if any gas escapes during the opening of the bottle it will find this weakened line first. The weakened line is quite small, a typical rib having a width of the order of one millimeter, but this is sufficient to enable full relief of the pressure from the interior of the bottle before the rip tab 22 has been fully pulled along the rip line 27. Thus, there is little or no danger of the cap being blown off and the amount of beverage lost or discharged is a minimum. As the side wall 12 is torn apart along the rip line 27 thereafter no gas escapes because all pressure has already been relieved.

It should be noted that even though the crimping action will crush the rib 38 at the crease 68, the groove beneath the upper part of the rib 38 will be opened to atmosphere as soon as the rip line portion 28 crosses. Gas escaping past the weakened portion across the ring 18 will readily relieve through the groove.

In FIGS. 8 and 9 there is illustrated a closure cap 80 which differs from the closure cap 60 only in the regard that the rip tab 22 has a different arrangement of ribs. In this case the U-shaped rib 38 does not extend past the rip line 27 and is only for strengthening and stiffening the rip tab. For the relief of internal pressure during the opening of the bottle 62 there is a central single rib 82 which crosses the rip line 27 and extends well up the side wall 12 to the upper portion of the bead at the rounded juncture 16. In FIG. 9 the tab 22 is shown partially pulled away from the remainder of the closure cap 80 and the upper end of the rib 82 has been separated from its lower end. Arrows indicate that gas is escaping by way of the upper end of the passageway under the rib and or in its vicinity to relieve the pressure in the bottle even though the remainder of the closure cap 80 is still in place and protects the user from blow off of the cap and from being inundated with the sudden discharge of beverage from the bottle.

Figure 10:
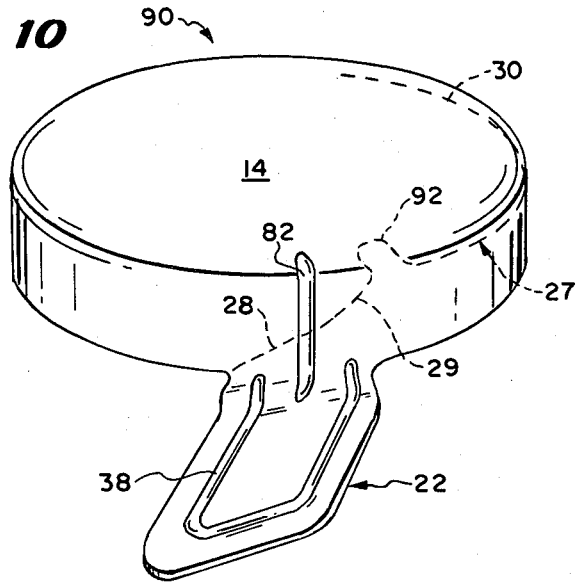
FIG. 10 is a perspective view of a modified form of the closure cap of the invention in which the center of the rip line extends up onto the crown of the cap.

In FIG. 10 there is illustrated a closure cap 90 which differs from the closure caps previously described herein only in the configuration of the rip line 27. In this case the beginning part 28 and the terminating part 30 are as previously described, but the center part 29 differs in that it has an upward excursion or diversion at 92 which extends well into the ring 18 and onto the crown 14. In this way the manipulation of the rip tab 22 will open the bottle interior to the atmosphere when the diversion 92 is reached if this has not occurred when the rib 82 is crossed.

Figure 11:
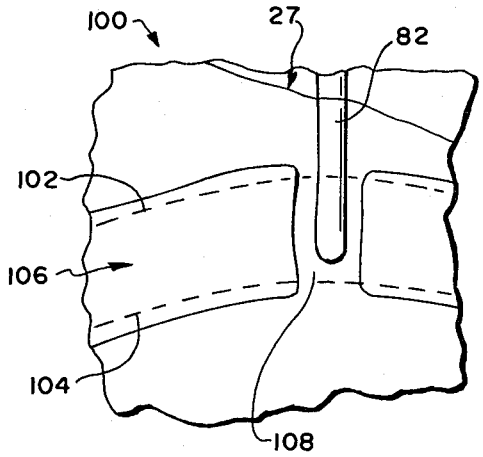
FIG. 11 is a fragmentary bottom plan view of a portion of a sheet metal blank in the process of being made into a closure cap of the invention having a special venting rib.

FIG. 11 shows an expedient for assisting the escape of gas from the interior of the bottle between the metal surface of the cap and the ring 18 of sealing compound at the weakened line which was described above. The view is a fragmentary bottom view of a closure cap 100 in the flat. It has not been formed yet. At 82 there is illustrated the groove on the interior of a rib such as in FIGS. 8, 9 and 10. The parallel dash lines 102 and 104 represent the part where the ring 18 will be laid down. It is preferred to apply an adhesive in the form of a lacquer to this area and such a strip is shown at 106. Instead of making the lacquer strip 106 continuous as would usually be done, it is discontinuous as indicated at 108. Thus although the ring 18 will fill the groove on the back of rib 82 it will not adhere as well at the groove. Thus, as the rip tab 27 separates the side wall 12 and crosses the rib 82 there is a better chance that gas will escape by way of the weakened area at the groove between the ring and the metal surface than between the ring and the axial end 66 of the bottle.

It should be mentioned here that for self-venting, that is when the closure cap is in place and pressure rises to the predetermined value that has been designed into the closure cap, it is believed the gas escapes between the ring 18 and the axial end 66 of the bottle. For this purpose it is believed the resilience of the side wall 12 enables slight spreading of the bottom edge 20 as the closure cap rides up the bead 64. The entire cap raises slightly permitting gas to pass beneath the ring 18 and out the sides of the cap around the side wall 12.

For purposes of claiming the invention, it will be taken in the claims that the juncture 16 is an extension of the side wall 12 and hence reference to the side wall will include the junction. Also for purposes of claiming the word "beverage" is used to designate any liquid or slurry that is edible and sold or dispensed in bottles.

In the process of installing the closure cap of the invention upon a bottle of beverage which is under pressure and/or in the course of pasteurizing or sterilizing the contents by putting the bottle in an autoclave the crown 14 may bulge slightly from its originally flat planar configuration. The description of the crown 14 is intended to include slight bulging of said crown.

The invention is capable of being embodied in closure caps made of steel suitably protected by coatings or plated to prevent corrosion, as well as other metals. Those skilled in the art will be able to ascertain the required characteristics of the material and its thickness and tensile strength as well as its response to work hardening to determine the parameters required to achieve the advantages which are ascribed to the invention. It is preferable, however, that the closure cap be formed of sheet aluminum or aluminum alloy in order to achieve the maximum of advantages of the invention. Aluminum and aluminum alloy closure caps are lighter in weight and more readily torn from the bottle. When constructed according to the invention they are at least as efficient as prior art closure caps.

In summary, there has been described a closure cap formed of aluminum or an aluminum alloy for containers, with an essentially disc-shaped cover which is joined by rounded juncture to a cylindrical jacket. The jacket is provided with a rip tab. An elastic sealing material in ring form is disposed on the interior of the cap essentially to line the upper half of the cylindrical jacket, the fillet in the transition from the cylindrical jacket to the cover and the cover area adjacent to the fillet. A rip line is provided on the inside of the cap extending along a path beginning near or at one end of the rip, crossing the rip tab area from the lower edge of the cylindrical jacket, inside the cylindrical jacket in an upward direction along an arch in the circumferential direction in that the metal band used for the manufacture of the closure cap has a thickness between 0.14 and 0.25 mm, preferably between 0.18 and 0.22 mm and, prior to the forming operation, a tensile strength between 90 and 220 N/mm2, preferably between 130 and 180 N/mm2. The rip line, after reaching the upper part of the cylindrical jacket, or of the transition between the cover and the jacket, extends essentially parallel to the lower edge of the cylindrical jacket, ending at a location of approximately 140 deg. to 180 deg. distant from the starting point of the rip line. The angle between the rip line tangent and the vertical plane taken through the axis of the cylindrical jacket always being less than 75 deg.

Considerable variations can be made in the closure cap of the invention without departing from the spirit or scope of the invention as defined in the appended claims. For example, the exact configuration of the rip tab can take many different forms; there can be a single rib-groove in the rip tab or above it or a series of ribs to provide a release of pressure when the closure cap is opened; the bottom flared end 20' may be used; etc.

What it is desired to secure by Letters Patent of the United States is:

1. A closure cap for a beverage bottle of the type which has a beaded rim including an annular axial end and an annular groove defined by the beaded rim where it terminates on the exterior of the bottle neck, the beverage when contained in the bottle after the closure cap has been installed thereon being at some time subjected to physical effects likely to increase the interior pressure in the space above the beverage, and said closure cap comprising:

A. a shallow substantially cylindrical inverted dish-like member having a cylindrical side wall, a substantially planar disc-shaped crown, the cylindrical side wall including a rounded annular juncture between the crown and the side wall forming an interior fillet, the dish-like member adapted to engage over the beaded rim of a bottle, the lower edge of the side wall being substantially circular and the side wall having a vertical dimension such that when said dish-like member is so engaged the side wall thereof may be crimped into engagement with the annular groove formed at the junction of said beaded rim with the bottle on its exterior, B. a rip tab having opposite side edges and a free end, said rip tab being connected to said lower edge along a small fraction of the circumference of said lower edge so that said rib tab is formed as an extension of said side wall, said rip tab having a length greater than the said vertical dimension of the side wall and extending generally radially outwardly of said side wall when said rip tab is in a horizontal plane, but adapted to be bent downwardly to lay close to the bottle neck when said closure cap is installed, C. a sealing member of gasket material disposed in said fillet on the interior of said dish-like member covering at least the upper portion of the interior of said side wall and extending radially inwardly of said crown at least sufficient to engage the annular axial end of the beaded rim of the bottle when installed, D. a rip line at least most of which is formed in said side wall of said dish-like member, said rip line having at least two parts, the first and beginning part commencing at a location comprising the meeting corner of one side edge of the rip tab and the lower edge of the side wall, continuing in a shallow rise from said lower edge and extending circumferentially of said side wall toward the rounded annular juncture in a direction to pass the second side edge of the rip tab, the second and terminating part being at a level spaced below the crown but at the upper part of said side wall and continuing circumferentially to a point on said level which is about half-way around the dish-like member from the location of the commencement of the rip line, said level, when the closure cap is installed, being at or slightly above the outermost diametrical extent of the said beaded rim, E. said dish-like member and rip tab being integrally formed by metal working including drawing from readily bendable sheet metal capable of work hardening to some extent whereby when installed said closure cap will be capable of containment of pressures which may be produced in said bottle above said beverage while enabling facile opening of said closure cap by pulling said rip tab in a generally circumferential movement to tear the side wall apart along said rip line.

2. The closure cap as claimed in claim 1 in which the two parts of the rip line are connected with none of said rip line reaching the rounded annular juncture.

3. The closure cap as claimed in claim 1 in which the two parts of the rip line are connected by a third part which has an excursion carrying the rip line into said rounded annular juncture.

4. The closure cap as claimed in claim 1 in which the sheet metal from which said closure cap is formed initially has a predetermined composition, thickness and tensile strength whereby the work hardening will provide sufficient resilience to cause self-venting and resealing of the closure cap if subjected to a particular range of internal pressure in the bottle.

5. The closure cap as claimed in claim 1 in which the rip tab has an angled free end providing long and short side edges, the said aforementioned one side edge being said long side edge whereby to induce the user to pull the rip tab toward the short side edge.

6. The closure cap as claimed in claim 1 in which means are provided for controlled relief of internal pressure while the user is operating the rip tab to remove an installed closure cap from a bottle.

7. The closure cap as claimed in claim 6 in which said means comprise at least one groove on the interior of the side wall in the vicinity of the rip tab and extending transversely of the rip line to and partially through said ring of gasket material whereby to provide a weakened area in the ring to permit gas relief from the interior of the bottle when the rip tab is pulled past the groove.

8. The closure cap as claimed in claim 7 in which said rip tab has upset rib means for strengthening said rip tab and said groove is formed under a portion of said rib means.

9. The closure cap as claimed in claim 1 in which said rip line is formed during the forming of said closure cap before installation as a tapered groove having a flat interior floor.

10. The closure cap as claimed in claim 1 in which the sheet metal is aluminum.

11. The closure cap as claimed in claim 1 or 9 in which the rip line is formed on the interior of said closure cap.

12. The closure cap as claimed in claim 10 in which the aluminum has a thickness on the order of 160 to 220 microns, a tensile strength on the order of 120 to 140 Newtons per $mm^2$.

13. The closure cap as claimed in claim 1 in which said rip tab has strengthening rib means at least adjacent the side edges thereof.

14. The closure cap as claimed in claim 13 in which a groove is provided on the interior of the side wall substantially aligned with the center of said rip tab and extending across the rip line and upwardly at least into the annular ring of gasket material to provide controlled release of pressure from the interior of the bottle during the pulling of the rip tab to divide the side wall at the rip line.

15. A closure cap of aluminum or an aluminum alloy for use on containers, said closure cap being formed from a metal band by working and having a disc-shaped cover portion having an under surface, a cylindrical jacket and a rounded juncture therebetween, the cylindrical jacket having a rip tab, a ring of elastic sealing material disposed interior of the cap and lining essentially the upper half of the cylindrical jacket including the rounded juncture and the under surface of the cover adjacent to the rounded juncture, said cap having a rip line formed on the interior of said cap and extending at least adjacent one end of the rip tab across the area adjacent to the rip tab and continuing along a path from the lower edge of the cylindrical jacket inside the cylindrical jacket upwardly in a circumferentially directed arch, said closure cap being integrally formed by metal working, including drawing, of a metal band capable of being worked, said band having a thickness between 0.14 and 0.24 mm, and, prior to the forming operation, a tensile strength between 90 and 220 N/mm2, the path of the rip line reaching a location proximate to the upper part of the cylindrical jacket extending essentially parallel to the lower edge of the cylindrical jacket, said path extending a distance of approximately 140 deg. to 180 deg. from its starting location with the angle defined between the rip line tangent and a plane coaxial with the axis of the cylindrical jacket always being less than 75 deg.

16. A closure cap according to claim 15 wherein said angle between the rip line tangent and said plane is always less than 45 deg.

17. A closure cap according to claim 15 or 16 in which the path of the said rip tab has first and second ends, and the path of the rip line, starting at a point at least near the first end of the rip tab at the edge of the cylindrical jacket, extends in a shallow arch upwardly toward the cover portion and continues from approximately the level of the second end of the rip tab in a direction approximately parallel to the outer edge of the cylindrical jacket.

18. A closure cap according to claim 15 wherein the metal band to be worked is between 0.18 and 0.22 mm in thickness and has a tensile strength prior to forming between 130 and 180 $N/mm^2$.

19. A closure cap in combination with a beverage bottle containing a beverage with a space in the bottle neck above the beverage, the beverage being at some time subjected to physical effects likely to increase the interior pressure in said space, said combination comprising:

A. a bottle of the type which has a beaded rim forming the mouthpiece, said rim having an axial annular end and terminating in a groove on the bottle neck, the groove having a diameter substantially less than the outer diameter of the rim, B. a closure cap sealingly engaged onto the rim, formed of thin, bendable sheet metal and adapted to be removed from said bottle by tearing the closure cap in a generally circumferential stroke of the user, said closure cap comprising i. an inverted dish-like member having a planar circular crown, a side wall connected to the crown and including a rounded juncture with said crown forming an interior fillet within the closure cap, the rounded juncture of said side wall being configured closely to engage against and follow the contours of the beaded rim, the bottom portion of the side wall having crimped engagement with said rim such that the bottom edge of said side wall is tightly engaged in said groove, ii. an annular layer of gasket material in said fillet and having a lateral extent at least sufficient to engage said axial annular end and at least partially to extend down the side wall, said layer being sealed against said axial annular end, iii. a rip tab connected with said bottom edge of the side wall and extending generally downward along the bottle neck, the rip tab having opposite generally parallel side edges and a free end, one side edge forming a corner with the bottom edge of the side wall, iv. a single continuously extending rip line in the side wall formed of at least two parts and comprising a first beginning part commencing at said corner and rising at a slanted shallow angle circumferentially and toward said crown in a direction to pass said second side edge of the rip tab, the rip line also comprising a second terminating part which is at a level spaced below said crown and said rip line continuing on said level to a location terminal about half way around the circumference of said side wall, v. said closure cap including the dish-like member and rip tab being integrally formed from said bendable sheet metal.

20. The combination as claimed in claim 19 in which the two parts of the rip line are connected, the first part rising to meet the second part and neither part being in said rounded juncture.

21. The combination as claimed in claim 19 in which the side wall when so engaged has substantially no visible corrugations therein.

22. The combination as claimed in claim 19 in which there is a weakened portion of said cap at a location proximate the juncture where the side wall joins the crown and disposed transverse of said annular layer of gasket material, access to said weakened area being established when said rip tab is pulled to separate the side wall along said rip line whereby to relieve pressure from said bottle by way of said weakened area.

* * * * *

UNITED STATES PATENT AND TRADEMARK OFFICE

CERTIFICATE OF CORRECTION

PATENT NO. : 4,431,111

DATED : February 14, 1984

INVENTOR(S) : HELMUT PROHASKA

It is certified that error appears in the above–identified patent and that said Letters Patent are hereby corrected as shown below:

Page 1, insert [30] Foreign Application Priority Data

--German Patent Application P 31 14 613.9 filed

April 10, 1981--

Col. 6, line 8, after "tab" insert, -- The gasket material can line essentially--

Signed and Sealed this

*Sixth* Day of *May 1986*

[SEAL]

*Attest:*

DONALD J. QUIGG

*Attesting Officer*

*Commissioner of Patents and Trademarks*